US012038004B2

(12) United States Patent
Dal Maso

(10) Patent No.: US 12,038,004 B2
(45) Date of Patent: Jul. 16, 2024

(54) POSITIVE DISPLACEMENT PUMP WITH BEARINGS, A KEYING DEVICE, AND GEARS

(71) Applicant: NOVA ROTORS SRL

(72) Inventor: Manuele Dal Maso, Camisano Vicentino (IT)

( * ) Notice: Subject to any disclaimer, the term of this patent is extended or adjusted under 35 U.S.C. 154(b) by 0 days.

(21) Appl. No.: 17/759,241

(22) PCT Filed: Feb. 12, 2020

(86) PCT No.: PCT/IB2020/051115

§ 371 (c)(1),
(2) Date: Jul. 21, 2022

(87) PCT Pub. No.: WO2021/161067

PCT Pub. Date: Aug. 19, 2021

(65) Prior Publication Data

US 2023/0053876 A1 Feb. 23, 2023

(51) Int. Cl.

| | |
|---|---|
| ***F04C 18/16*** | (2006.01) |
| ***F04C 29/00*** | (2006.01) |
| ***F04C 29/02*** | (2006.01) |

(52) U.S. Cl.

CPC ..... *F04C 18/16* (2013.01); *F04C 29/005* (2013.01); *F04C 29/02* (2013.01); *F04C 2240/50* (2013.01)

(58) Field of Classification Search

CPC ..... F04C 18/16; F04C 29/005; F04C 29/02; F04C 2240/50

See application file for complete search history.

(56) References Cited

U.S. PATENT DOCUMENTS

| | | | |
|---|---|---|---|
| 4,047,858 | A | 9/1977 | Zalis |
| 2002/0131884 | A1 | 9/2002 | Mito et al. |
| 2007/0004186 | A1 | 2/2007 | Ozawa et al. |

FOREIGN PATENT DOCUMENTS

| | | | |
|---|---|---|---|
| CN | 204003439 | U | 12/2014 |
| DE | 2601138 | A1 | 7/1977 |

(Continued)

OTHER PUBLICATIONS

International Search Report for corresponding PCT/IB2020/051115, dated Oct. 9, 2020.

(Continued)

*Primary Examiner* — Mary Davis
(74) *Attorney, Agent, or Firm* — Egbert, McDaniel & Swartz, PLLC

(57) ABSTRACT

Rotary positive displacement pump having a one-piece drive housing provided with an opening with a closing cover and with bearing seats engaging at least one bearing, wherein a primary drive shaft and a secondary drive shaft are each rotationally engaged to the bearings of the opposite bearing seats of their own axis, each drive shaft being provided with at least one gear which is interposed between the opposite bearing seats, and wherein each drive shaft engages a positive displacement screw rotor placed within a stator body, the positive displacement screw rotors being intended to enable the generation of a product flow between a product inlet duct and a product outlet duct with which the product section is provided, and wherein the gears are monolithic and at least one of the gears is keyed to the drive shaft by a keying device for hollow shafts.

6 Claims, 4 Drawing Sheets

(56) References Cited

FOREIGN PATENT DOCUMENTS

| | | | | |
|---|---|---|---|---|
| DE | 102014002395 | A1 | | 8/2015 |
| EP | 0135256 | A1 | * | 3/1985 |
| EP | 0401741 | B1 | | 3/1993 |
| EP | 2910783 | A1 | | 8/2015 |
| EP | 3196466 | A1 | | 7/2017 |
| EP | 2615307 | B1 | | 8/2019 |
| WO | 2015046318 | A1 | | 4/2015 |

OTHER PUBLICATIONS

Written Opinion of the International Searching Authority for corresponding PCT/IB2020/051115, dated Oct. 9, 2020.

* cited by examiner

POSITIVE DISPLACEMENT PUMP WITH BEARINGS, A KEYING DEVICE, AND GEARS

The present invention relates to a positive displacement pump.

The invention finds particular—although not exclusive—application in the production and marketing of positive displacement pumps particularly intended for use in the food, cosmetic and pharmaceutical industries, and, more widely speaking, the solution according to the present invention finds application in the production and sale of equipment and devices for handling liquids and fluids.

PRIOR ART

Among the machines intended for lifting and/or moving liquids and fluids, pumps are certainly the oldest and best known. Although of different kinds and design, the pumps intended for moving liquids or fluids are all characterised by the exchange of energy with a fluid, as far as of interest, transforming mechanical energy into—for example—potential or kinetic energy, which is transferred to a fluid. In this context, we would like to mention the classic distinction between positive displacement machines, in which energy is transmitted by means of the static pressure applied to the mobile walls, which, by moving, determine the volume in which the fluid is present, and dynamic machines, in which energy is transmitted by means of the force applied to the members of the machines and of the consequent variation in the quantity of motion in the fluid. Generally speaking, positive displacement pumps are characterised in that they act by cyclically filling one volume and emptying another volume by means of the reciprocating or rotary movement of one or more members. With regard to the sector of interest only, with reference to screw pumps, in the latter the fluid flows between the pump body and an approximately helical rotor in which, during motion, the longitudinal axis shifts parallel to itself. Therefore, on the basis of said structure, the operation of a positive displacement pump of the screw type provides that, upon rotation of the screw rotors, some spaces are formed on the suction side of the pump, which are characterized by growing volume, carrying out the priming, and, upon continuing the rotation, the toothing of the main—driving—rotor penetrates the secondary—satellite—rotor, creating an insulated chamber with respect to the suction environment and whose volume translates axially up to the delivery chamber. Among the technical features common to the different solutions of positive displacement pumps of the screw type, one can point out the lack of valves on the pump body; a relative compactness of the pump; linear flow rates dependent on the value of the number of revolutions; prevalence of a value independent of the value of the number of revolutions; capability of pumping thick and viscous fluids and a yield highly dependent on the working precision of the pump components, in particular of the screw rotors, and on the keeping of low values of the design clearances.

With particular reference to the technical scope of the invention, different solutions of positive displacement pumps of the screw type can also be found in patent literature. Among the solutions found in the prior art, we would like to mention:

D1: EP2910783 (Jung & Co) (DE102014002396)
D2: EP0401741 (Alcatel) (DE69000990)
D3: EP2615307 (Vacuubrand) (US2013183185)
D4: CN204003439 (Zhejiang)
D5: U.S. Pat. No. 4,047,858 (Zalis)

D6: US2007/0041861 (Ozawa)
D7: WO2015/046318
D8: DE102014002395 (Jung)
D9: EP3196466 (Fristam)

D1 synthetically describes a double-screw positive displacement pump of single flow design having a pump housing of the section type having a pump section, a bearing support section and a gear drive section, the bearing section and the pump section being configured separately from one another, each of the drive shafts, which are parallel to each other, being supported by axial and radial bearings placed on the same axis, said drive shafts being synchronously rotationally moved by suitable gears keyed to the drive shafts themselves in correspondence of one of their ends, wherein said bearing unit is arranged in a section of the pump that is separate from that of the bearing unit, and wherein in said solution the positive displacement screws are structured in such a way as to perform an operation providing extrusion and transport since the respective portions of the screws performing said functions have the same pitch.

D2 synthetically describes a positive displacement pump of the type with positive displacement screws comprising two positive displacement screws mounted on respective drive shafts, wherein said drive shafts to which said positive displacement screws are keyed rotate synchronously by means of a synchronised gearbox provided with gears, each drive shaft being suitably provided with an own gear, wherein the positive displacement gears associated with the drive shafts are placed on a suitable housing in a section of the pump body separate from the section of the pump in which the synchronised gearbox for moving the drive shafts is present, said synchronised gearbox being placed in a suitable housing obtained in the body of the pump, and wherein said synchronised gearbox is positioned between two bearing units, which are placed on the same section of the pump in which the synchronised gearbox itself is present.

D3 synthetically describes a screw rotor for a screw pump which, in the solution described is of the vacuum type, wherein the rotor is suitably structured to withstand high operating pressures, said pump comprising a rotor with reduced thermal expansion allowing the pump to operate with high pressure levels and simultaneously allowing to reduce any possible jamming of the screw rotors as a consequence of the reduced interconnection tolerances and of the thermal expansions due to the operation temperatures at high pressures, said pump being structured in such a way as to comprise a suitable housing realizing a stator shaped for the functionality of the screw rotors, which are provided with a portion made of materials able to ensure greater heat dissipation, and wherein in said solution the drive shafts of the screw rotors are positioned in a different section of the pump in which the bearing units are positioned, interposed to which are some synchronised drive devices including two suitably magnetised cylinders that are suitably provided with electrical windings in such a way as to enable a counter-rotation with respect to each other in a synchronised way.

D4 describes a positive displacement pump of the double-screw type with positive displacement screw providing a partial rubber coating, wherein said pump comprises a pump body, a drive gearbox and a gear reducer, wherein two drive shafts are arranged parallel to each other in a suitable housing of the pump body, wherein the spiral blades of the positive displacement screws are mounted on each shaft of the pump, a rubber layer being provided on the surface of each spiral blade of the positive displacement screws, wherein each shaft of the pump is suitably supported in the gear case, it being provided that one gear is placed at the end of each drive shaft, said gears being connected to realize the drive, it also being provided that said drive realizes a synchronised gearbox in which a drive shaft is connected on one of the synchronised gears, it being arranged to actuate the gear reducer, said gears being interposed between bearings.

D5 synthetically describes a positive displacement pump of the type particularly intended for processing high density fluids, provided with a pair of positive displacement screws and comprising a pump body suitably provided with at least one inlet duct for product inlet and with at least one outlet duct for product outlet, wherein two positive displacement rotors are provided with suitable positive displacement screws and with drive shafts engaging said rotors for the synchronous rotation thereof, which occurs by prearranging a gear unit with which said pump is provided, wherein said gears engage each other being keyed in correspondence of the same area near the end of the drive shafts, which are thus counter-rotating with respect to each other, wherein said drive shafts and said rotors are suitably supported by bearings arranged in correspondence of the head of the rotors and oppositely near the portion of the drive shafts where the gears are keyed.

D6 describes a screw rotor in a pump for creating vacuum wherein it is possible to limit the length of the screw rotor while increasing its efficiency, wherein the screw rotor has a different pitch between two sections thereof of which one upstream and one downstream along the moving path of the gases, wherein the downstream thread pitch is lower than the upstream thread pitch, wherein the drive case of the pump is engaged to the pump body and consists of two pieces of which a lower piece and an upper piece and includes the drive devices, which are made in such a way as to include a series of gears of which those keyed to the drive shafts of the helical rotors are counter-rotating with respect to each other, said drive shafts of the screw rotors being suitably supported by oppositely arranged bearing units.

D7 synthetically describes a positive displacement pump for transporting substances able to act as a mixing device as well, creating a device that is also able to reduce overall installation dimensions, wherein said pump is provided with a pair of screw rotors that peripherally penetrate each other without being in contact with each other, wherein said pump is provided with a main body realizing the stator of the screw rotors of the pump itself, and wherein a chamber for the screw rotors and a drive housing section are provided, wherein a bearing unit is connected to the section of the pump where the rotors are present and another bearing unit is arranged near the end of the drive shafts of the screw rotors, a synchronised gearbox being arranged between said bearing units enabling the counter-rotation of the rotors as the drive shafts of the pump are suitably connected to the screw rotors, and wherein the rotary shafts for mixing are connected to the free ends of the screws of the pump.

D8 describes a positive displacement pump with a double single-flow screw rotor, wherein the pump body is divided into portions of which a pump portion with a conveyor, a mixing section with a respective mixing chamber, a bearing portion and a drive portion, wherein said portions are separate from each other in space, wherein a hydraulic separation is present between the pump section that is in communication with the mixing portion and the section in which the drive mechanism and the bearings are present, said sections being tight by means of suitable seals, furthermore a first section of said sections realizes the stator within which the two screw rotors counter-rotate penetrating each other without contact, each rotor being keyed to an own drive shaft coaxial to the rotor itself, and wherein said drive shafts are placed in a suitable open case provided with a closing cover of the second section of the pump body, wherein said drive shafts are suitably supported by bearings arranged in correspondence of areas near the ends of said drive shafts, wherein the drive gears are interposed between said bearings.

D9 illustrates a rotary positive displacement pump arranged externally with at least two positive displacement bodies operated synchronously with respect to each other, which are fixed onto shafts associated on the end side, wherein the shafts are arranged through a first bearing operating radially and a second bearing operating radially and axially, respectively, the bearings being adapted in reception bores of a housing made in one single piece and wherein the shafts are coupled with each other by means of a synchronised gearbox, wherein the synchronised gearbox is arranged between the respective bearings and has two pinions engaging each other whose diameter is larger than the distance of the axis of the shafts, wherein the pinions respectively have a toothed crown that is fixed on a load-bearing body and wherein the maximum external diameter of the load-bearing bodies is smaller than the distance of the axis of the shafts.

Drawbacks

All the known solutions of positive displacement pumps as in the prior art have some defects and limits that are translated into consequent disadvantages.

A first limit involving all the known solutions of rotary positive displacement pumps, according to the applicant, lies in the fact that said solutions are not optimised in terms of a suitable mechanical resistance to the stresses to which the members of the drive, which sets in rotation the drive shafts and, as a consequence, the positive displacement screws, are subjected, especially in case of a high rotation speed and in the treatment of highly viscous liquids or fluids.

A second limit involving all the known solutions of rotary positive displacement pumps, according to the applicant, lies in the fact that said solutions, given their structure, do not allow to realize a coupling of the drive devices with the drive shafts enabling a better setting and centring of the devices making up the drive, in particular of the devices that have to be keyed to the drive shafts as they are intended to set the latter in counter-rotation.

Another limit of the currently known solutions of rotary positive displacement pumps as in the prior art, according to the applicant, lies in the fact that, as a consequence of their structure, in particular of the drive devices enabling the reciprocal rotating movement of the drive shafts, it is not possible to obtain a positive displacement pump able to keep within low limits the vibrations generated by the rotation of the drive shafts and by all the devices connected to the latter, particularly in the case in which the positive displacement pump is operated at high speed.

A further limit that, although to a different extent, involves all the solutions of rotary positive displacement pumps as in the known prior art, according to the applicant, lies in the fact that said solutions of positive displacement pumps cannot be assembled easily and do not allow to perform easy maintenance or reactivation interventions in case of failure.

Another limit that, according to the applicant, involves all the solutions of rotary positive displacement pumps as in the known prior art, particularly the solutions providing the use of gears among the drive devices for rotating the drive shafts with which the positive displacement rotors are associated, lies in the fact that the currently known solutions of rotary positive displacement pumps, given the current design of the drive devices, not allowing to obtain, already in the pump assembly phase, an optimal centring at least of the primary gear, do not allow to combine an optimal strength at least of the primary gear with a just as optimal precision and lower setting complexity of the positive displacement screw rotors and, as a consequence, do not allow to keep unchanged the settings of the positive displacement screw rotors that were made even after the engagement of the gear. In particular, the current solutions providing the use of a keying device for engaging the gear with the drive shaft do not allow to prevent the drawback, linked to the use of keying devices not for hollow shafts, consisting of the impossibility of preventing the engagement of said keying devices in expansion within the seat of the gear body, given the remarkable expansion strength values developed, from causing a deformation of the gear body itself, with the consequent impossibility of using gears having a gear body that is not oversized.

As a whole, from these introductory remarks, it can be inferred that it is essential to find some alternative solutions.

The aim of the present invention is also to solve the above-mentioned drawbacks.

SUMMARY OF THE INVENTION

This and other aims are achieved by the present invention according to the characteristics as in the appended claims, solving the above-mentioned drawbacks by means of a rotary positive displacement pump (1) comprising a one-piece drive housing (6) provided with an opening (8) with a closing cover (9) and with bearing seats (12, 13, 14, 15) engaging at least one bearing, wherein a primary drive shaft (16) and a secondary drive shaft (17) are each rotationally engaged to the bearings of the opposite bearing seats (12, 13, 14, 15) of their own axis, each drive shaft (16, 17) being provided with at least one gear (32, 35) that is interposed between the opposite bearing seats (12, 13, 14, 15) and wherein each drive shaft (16, 17) engages a positive displacement screw rotor (4, 5) placed within a stator body (47), said positive displacement screw rotors (4, 5) being intended to enable the generation of a product flow between a product inlet duct (48) and a product outlet duct (50) with which the product section (3) is provided, and wherein the gears (32, 35) are monolithic and at least one of said gears (32, 35) is keyed to the drive shaft (16, 17) by means of a keying device (34) for hollow shafts.

Aims and Advantages

In this way, by the considerable creative contribution, the effect of which constitutes immediate technical progress, many advantages are achieved.

A first advantageous aim of the present invention is to obtain a rotary positive displacement pump by means of which, with respect to the currently known solutions of rotary positive displacement pumps and also thanks to the particular realization of the drive devices, particularly of the gears and of the keying device, it is possible to significantly improve the mechanical strength of the drive members that set into rotation the drive shafts and, as a consequence, the positive displacement screws, thus ensuring a nearly absolute lack of clearances and increasing the strength and the overall duration of the positive displacement pump even if the latter is operated at a high rotation speed or in the treatment of highly viscous fluids or liquids.

A second advantageous aim of the present invention is to obtain a rotary positive displacement pump by means of which, with respect to the currently known solutions of rotary positive displacement pumps, it is possible to significantly facilitate positioning accuracy, centring and reciprocal alignment of the gears making up the drive and, as a consequence, to obtain an overall improvement of the setting of said gears and of the assembly phases due to an improvement of the assembly precision of the various components with an improvement also in terms of a reduction in the times necessary for setting up the positive displacement pump.

Another advantageous aim of the present invention is to obtain a rotary positive displacement pump which, with respect to the currently known solutions of rotary positive displacement pumps, is able to significantly reduce the vibrations generated by the rotation of the drive shafts and by the various rotary devices connected thereto, both in the case in which the positive displacement pump is operated at low speed and in the case in which it is operated at high speed.

A further advantageous aim of the present invention is to obtain a rotary positive displacement pump by means of which, with respect to the currently known solutions of rotary positive displacement pumps, it is possible to reduce the need for maintenance interventions as well as to facilitate maintenance or reactivation interventions that have to be performed.

Another advantageous aim of the present invention is to obtain a rotary positive displacement pump thanks to whose innovative structure, particularly due to the shape of the primary drive shaft in correspondence of the engagement section of the primary gear, as well as of the primary gear itself, which is provided with a particular engagement seat and which can be keyed to the drive shaft by using a keying device for hollow shafts, it is possible to obtain an optimal centring of the primary drive gear already during its assembly on the drive shaft, in such a way as to facilitate and enhance the setting of the positive displacement screw rotors, also preventing said setting, once occurred, from being altered by the engagement of the primary gear with the drive shaft by means of the keying device. In particular, thanks to the innovative structure of the primary gear, which can be keyed to the primary drive shaft by means of a keying device for hollow shafts—said keying device engaging the gear in correspondence of a pre-arranged collar overhanging outside the gear body—it is possible to obtain a keying that, despite the use of a keying device, is free from all types of induced deformation of the gear body, while allowing to limit the overall dimensions of the gear body itself without affecting its mechanical strength for the benefit of a greater overall strength of the positive displacement pump and for the benefit of a reduction of the pump's overall dimensions, without affecting its performance.

These and other advantages will be apparent from the following detailed description of some preferred embodiments with the aid of the enclosed schematic drawings, whose details of execution are not to be considered limitative but only illustrative.

CONTENT OF THE DRAWINGS

PRACTICAL REALIZATION OF THE INVENTION

Figure 1:
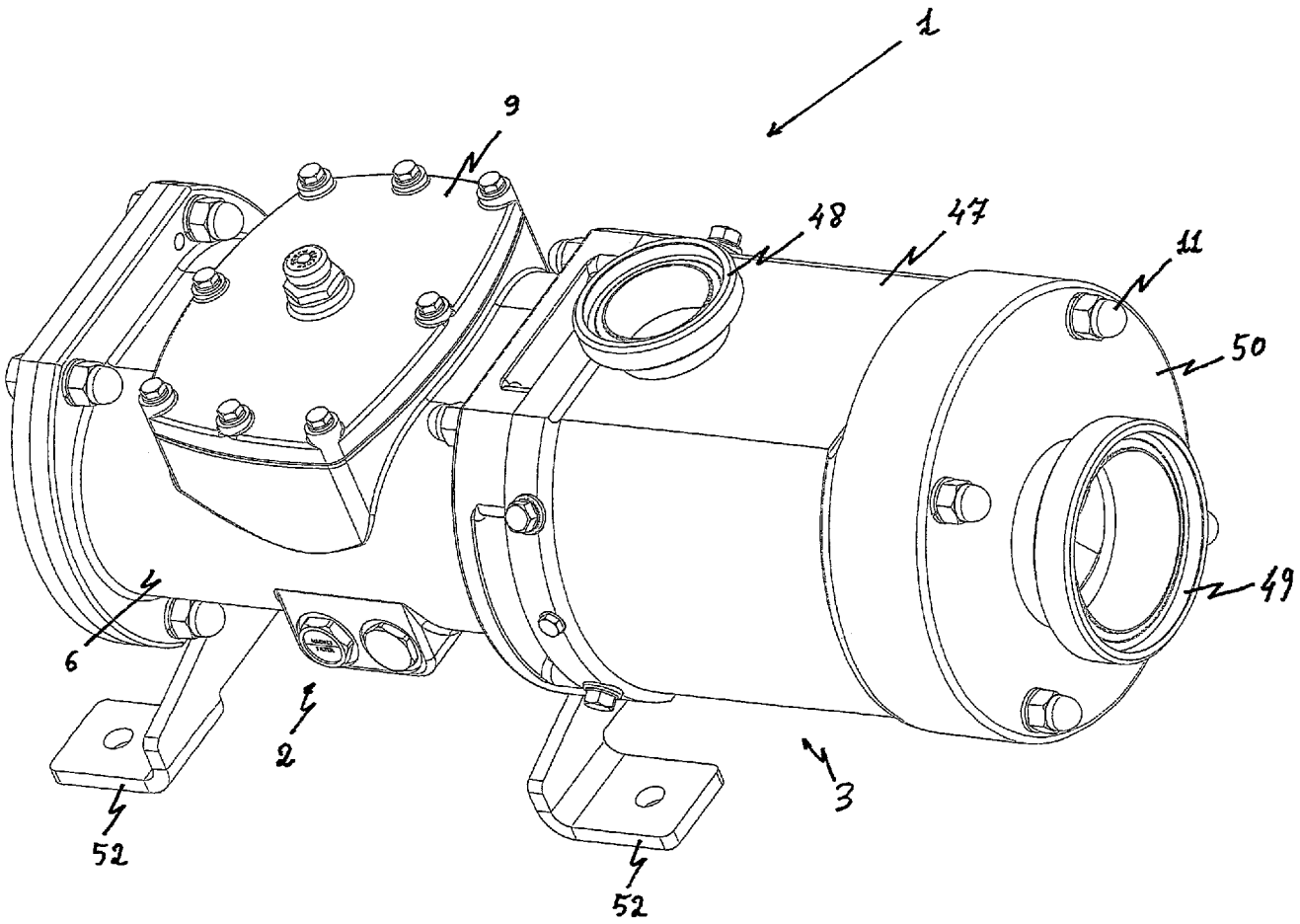
FIG. 1 shows a three-quarter ensemble top view of the rotary positive displacement pump fully assembled according to the present invention.
Figure 2:
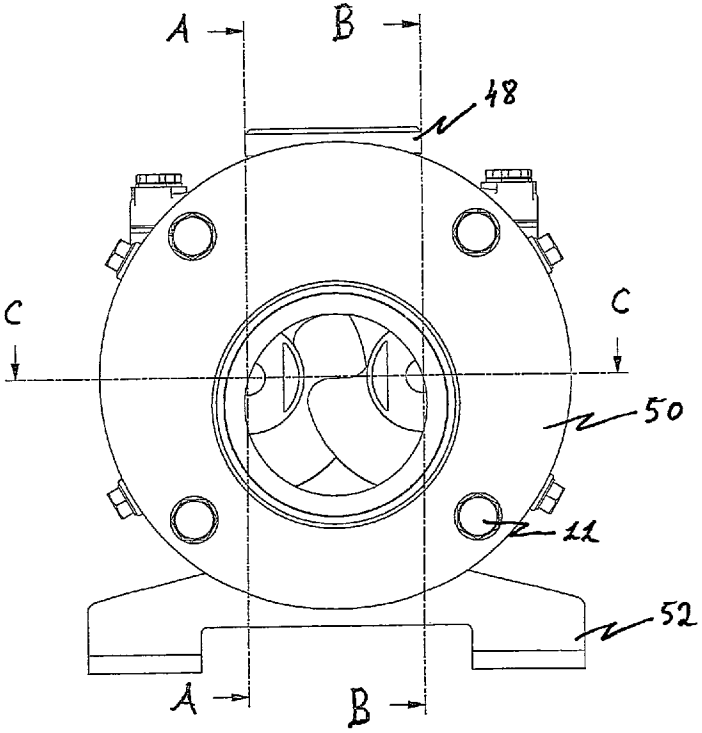
FIG. 2 shows a front orthogonal view of the rotary positive displacement pump according to the present invention in which the section axes can be seen.
Figure 3:
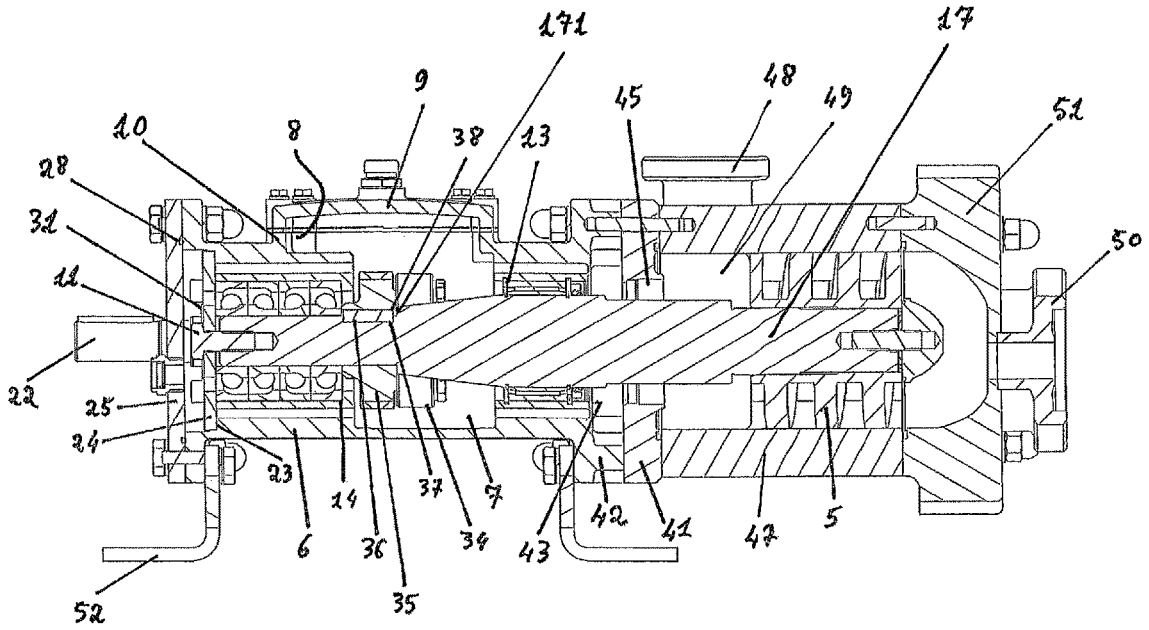
FIG. 3 shows a view in longitudinal section along the axis A-A of FIG. 2 of the rotary positive displacement pump according to the present invention.

With reference to the content of the drawings as well, a rotary positive displacement pump (1) is disclosed, which is particularly intended for use in the food, cosmetic and pharmaceutical industries since it can be used with highly viscous fluids as well and since it is structured in such a way as to be intended to prevent the fluid being processed from coming into contact with contaminants or from deteriorating as a consequence of the mechanical action of the screw rotors, said positive displacement pump (1) in the embodiment disclosed, as shown in FIGS. 1 to 5, being a rotary positive displacement pump (1) having positive displacement screw rotors, wherein two positive displacement screw rotors (4, 5) are provided, which peripherally penetrate each other without being in contact with each other as they counter-rotate with respect to each other. In greater detail as to the embodiment disclosed in FIGS. 1 to 5, and in particular as shown in FIG. 3 and in FIG. 4, the positive displacement pump (1) according to the present invention is made in such a way as to comprise two contiguous sections of which a drive section (2) and a product section (3), the latter containing the positive displacement screw rotors (4, 5). In particular, the drive section (3) is made in such a way as to create a drive housing (6) consisting of a one-piece metal case suitably made by melt-moulding or by any other known process, said drive housing (6) being made in such a way as to comprise a suitable lubrication chamber (7) basically acting as an oil sump, it being provided that an opening (8), which is partially above said lubrication chamber (7), is made in such a way as to be able to butt up against, in engagement, a closing cover (9) of the type intended to be engaged to the perimeter engagement wall (10) surrounding said opening (8) of the drive housing (6). Furthermore, the area of said opening (8) is such as to enable inspection and, in accordance with the size of the positive displacement pump (1), to provide access to the lubrication chamber (7) for assembly or maintenance operations. In the embodiment disclosed, as particularly shown in FIG. 3 and in FIG. 4, said closing cover (9) is engaged to the perimeter engagement wall (10) surrounding the opening (8) of the drive housing (6) by means of threaded engagement devices (11), in the embodiment disclosed said threaded engagement devices (11) being some screws, said threaded engagement devices (11) being suitably placed in engagement seats with which both the closing cover (9) and said perimeter engagement wall (10) of the drive housing (6) are provided.

Furthermore, the drive housing (6) is made in such a way as to comprise some bearing seats (12, 13, 14, 15) arranged in opposite pairs on the same axis. Said bearing seats (12, 13, 14, 15) are made, according to what is particularly shown in FIG. 3 and in FIG. 5, in such a way that one or more of said bearing seats (12, 13, 14, 15) can also engage multiple bearings arranged adjacently after one another. In greater detail, the positive displacement pump (1) according to the present invention, in order to enable operation by rotating the positive displacement screw rotors (4, 5), is provided with two monolithic drive shafts (16, 17), of which in particular a primary drive shaft (16), the driving shaft, and a secondary drive shaft (17), the driven shaft, wherein both the primary drive shaft (16) and the secondary drive shaft (17) are supported by their own bearing units (18, 19, 20, 21), each bearing unit (18, 19, 20, 21) comprising at least one bearing that is engaged to the respective bearing seats (12, 13, 14, 15). In greater detail as to the embodiment disclosed, the primary drive shaft (16) is supported by a first bearing unit (18), which in the embodiment disclosed comprises a series of four oblique ball bearings able to operate both radially and axially, and by a second bearing unit (19), which in the embodiment disclosed comprises a needle bearing able to operate at least radially, wherein the first bearing unit (18) is engaged within the first bearing seat (12) and the second bearing unit (19) is engaged within the second bearing seat (13) of the drive housing (6) of the drive section (2) of the positive displacement pump (1). In accordance with what is provided for the primary drive shaft (16), the secondary drive shaft (17), too, is supported by a third bearing unit (20), which in the embodiment disclosed comprises a series of four oblique ball bearings able to operate both radially and axially, and by a fourth bearing unit (21), which in the embodiment disclosed comprises a needle bearing able to operate at least radially, wherein the third bearing unit (20) is engaged within the third bearing seat (14) and the fourth bearing unit (21) is engaged within the fourth bearing seat (15) of the drive housing (6) of the drive section (2) of the positive displacement pump (1).

Figure 4:
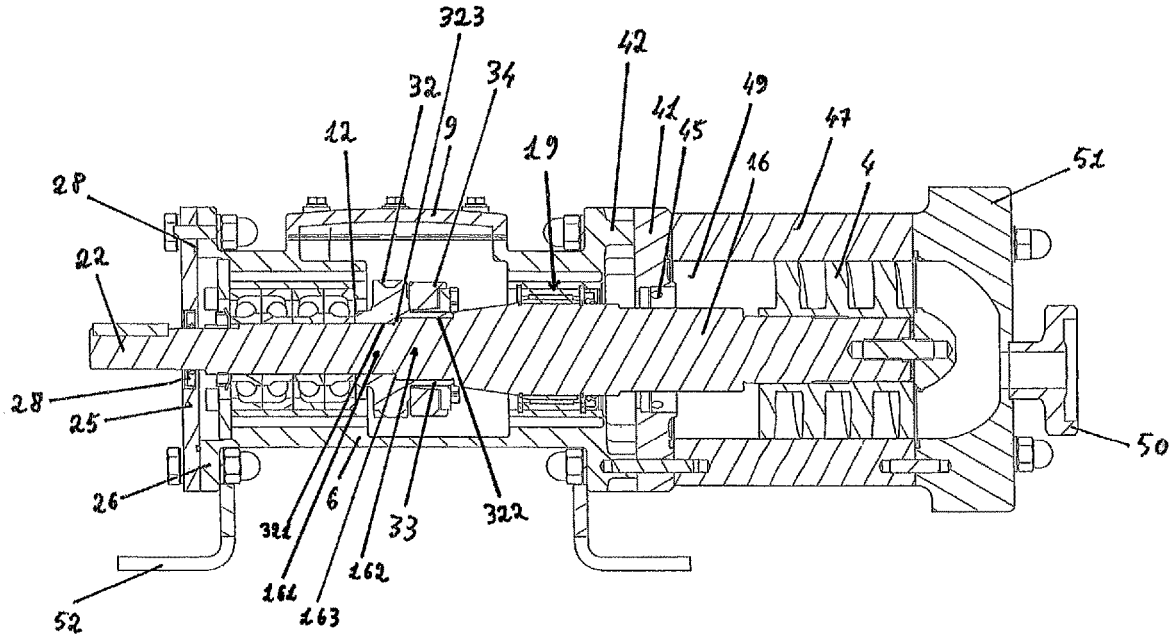
FIG. 4 shows a view in longitudinal section along the axis B-B of FIG. 2 of the positive displacement pump according to the present invention.
Figure 5:
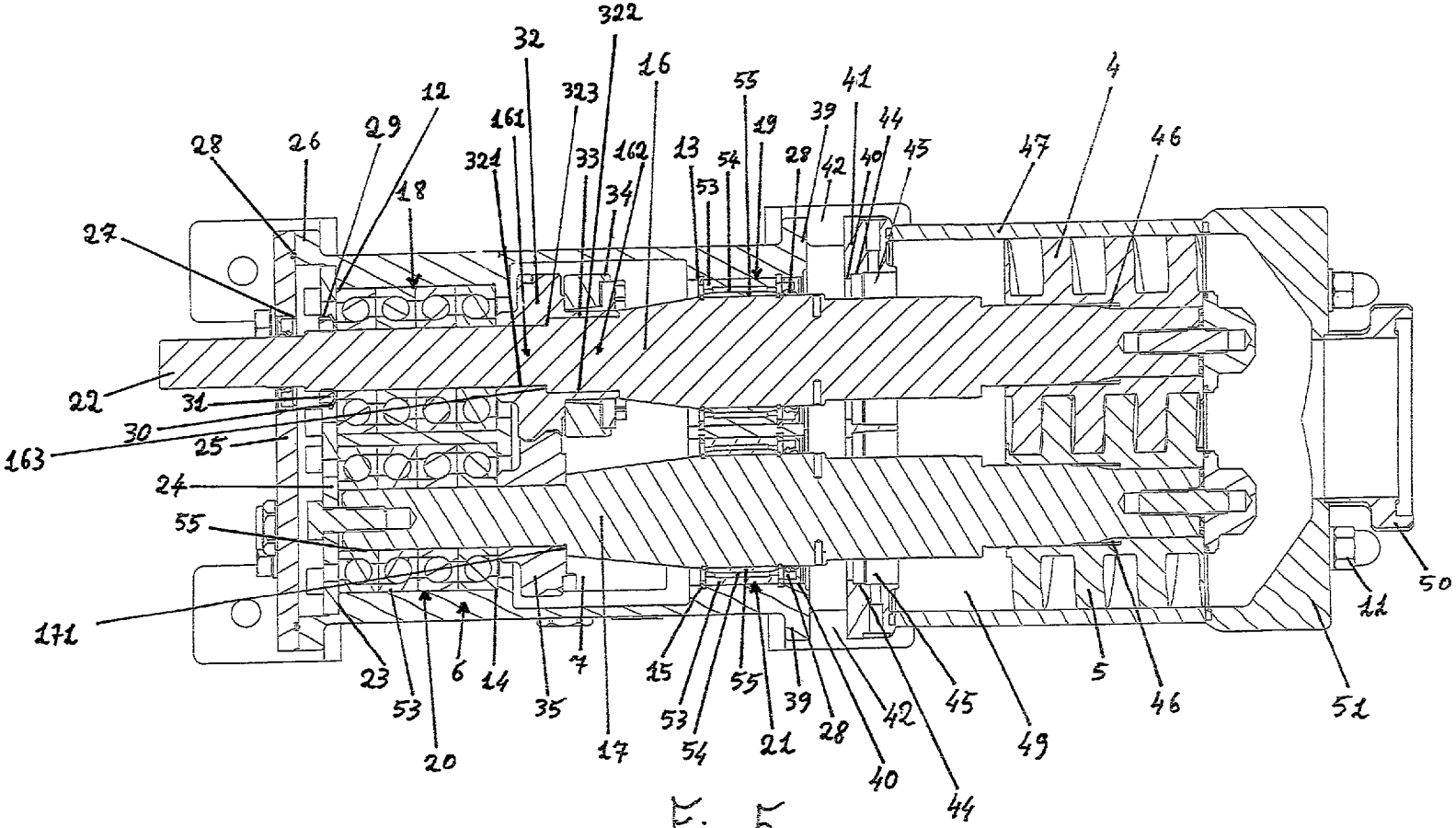
FIG. 5 shows a view in longitudinal section along the axis C-C of FIG. 2 of the positive displacement pump according to the present invention.

As it is particularly shown in FIG. 4, the primary drive shaft (16) comprises, for the coupling with a driving motor of the known type, a driving pivot (22) protruding both from the head wall (23) of the drive housing (6) and from a bearing locking plate (24), which is suitably engaged to the head wall (23) of the drive housing (6) by means of suitable threaded engagement devices (11), which, in the embodiment disclosed, are some Allen screws. Said driving pivot (22) also protrudes with respect to a closing plate (25), which is engaged, by means of coupling pins and threaded engagement devices (11), with the interposition of a sealing device (28), which in the embodiment disclosed is an O-ring, to a protruding head flange (26) with which the drive housing (6) is provided in correspondence of the head wall (23), said closing plate (25) being suitably provided with a through-seat (27) for the passage of the driving pivot (22), said through-seat (27) being further provided with a sealing device (28) of the known type, in the embodiment disclosed said sealing device (28) being a sealing ring of the known type. Furthermore, in order to correctly lock the internal rings (55) of the bearings of the first bearing unit (18) and of the third bearing unit (20), it is provided that, for locking the internal rings (55) of the bearings of the first bearing unit (18), in correspondence of the portion of the primary drive shaft (6) coming out of the head wall (23) of the drive housing (6), in engagement on a through-opening (29) with which the bearing locking plate (24) is provided, there is a safety washer (30), of the type with radial toothing, cooperating for engagement with a locking ferrule (31) of the known type, whereas, for locking the internal rings (55) of the third bearing unit (20), the locking ferrule (31) of the known type is engaged to the secondary drive shaft (17) by means of a threaded engagement device (11).

For functional purposes, the secondary drive shaft (17) is positioned parallel to the primary drive shaft (16), the two shafts being synchronously moved in counter-rotation with respect to each other by means of a synchronised drive, which is structured in such a way as to comprise a primary gear (32) engaging a secondary gear (35), both of which are suitably provided with an axial through-seat that enables their keying to the drive shafts (16, 17). The primary gear (32) is monolithic and, in the embodiment disclosed, is of the type with helical teeth, said primary gear (32) being keyed to the primary drive shaft (16) by means of a mechanical keying device (34). In greater detail as to the embodiment disclosed, as it is also particularly shown in FIG. 4 and in FIG. 5, the primary gear (32) is made in such a way as to comprise a tubular overhanging collar (33), which is intended to be engaged to the primary drive shaft (16) by means of the keying device (34), the latter being a keying device (34) for hollow shafts, in such a way as to make the primary gear (32) integral with the primary drive shaft (16) by exploiting only the friction generated by the keying device (34), wherein said keying device (34) is of the known type and consists of two parts of which a flanged cone co-penetrating a suitable counter-cone, said co-penetration being adjusted by a series of threaded engagement devices (11), of the screw type, arranged in a radial pattern on the flange, the internal cone being provided with a suitable longitudinal cut such as to enable the reciprocal co-penetration thereof due to the setting of the threaded engagement devices (11) in such a way as to allow the internal cone, by tightening the overhanging collar (33) of the primary gear (32), to cause the latter to become integral with the primary drive shaft (16). In greater detail, as it is particularly shown in FIG. 4 and in FIG. 5, in order to ensure the optimal positioning for keying the primary drive gear (32) to the primary drive shaft (16), the primary drive shaft (16) itself in correspondence of the portion intended to be engaged to the primary gear (32) is made in such a way as to comprise a first engagement portion (161) and a second engagement portion (162) having a different diameter with respect to each other, wherein, in the embodiment disclosed, the first engagement portion (161) has a smaller diameter with respect to the adjacent second engagement portion (162), whose diameter is larger than said first engagement portion (161). Furthermore, between the first engagement portion (161) and the second engagement portion (162) a first vertical abutment wall (163) is provided, whose height is given by the difference between the diameter of the second engagement portion (162) and the diameter of the first engagement portion (161).

In order to enable its optimal engagement to the primary drive shaft (16), the primary gear (32) is made in such a way that the through-seat enabling its keying is made in such a way as to comprise a first keying seat (321) and an adjacent second keying seat (322) of a different diameter with respect to each other. In greater detail, the first keying seat (321) has a diameter compatible for the precise keying with the first engagement portion (161) of the primary drive shaft (16), said first keying seat (321), in the embodiment disclosed and preferably, extending axially over at least most of the axial length of the gear body of the primary gear (32) while the second keying seat (322) has a diameter compatible for the keying with the second engagement portion (162) of the primary drive shaft (16), said second keying seat (322), in the embodiment disclosed, extending axially over the whole axial length of the overhanging collar (33) and over the part of the gear body not affected by the first keying seat (161). Furthermore, in order to make completely compatible the engagement of the primary gear (32) with the primary drive shaft (16), said second keying seat (322) is provided with an abutment wall (323) compatible for the engagement with the vertical abutment wall (163) of the primary drive shaft (16). In greater detail, the tolerance between the first keying seat (321) and the first engagement portion (161) of the primary drive shaft (16) is very much limited as the diameter of the first keying seat (321) is extremely precise with respect to the diameter of said first engagement portion (161) of the primary drive shaft (16), while the tolerance between the second keying seat (322) and the second engagement portion (162) of the primary drive shaft (16) is lower than that between the first keying seat (321) and said first engagement portion (161) of the primary drive shaft (16), in any case said tolerance between the second keying seat (322) and the second engagement portion (162) of the primary drive shaft (16) must be compatible with the tolerance values for keying by means of the keying device (34) for hollow shafts. The described structure of the first keying seat (321) and of the second keying seat (322) of the primary gear (32) compatible for the engagement of the first engagement portion (161), of the second engagement portion (162) and of the vertical abutment wall (163) of the primary drive shaft (16) allows to realize a primary gear (32), which combines optimal values of mechanical strength with suitable overall dimensions, all this being also allowed by the use of the keying device (34) for hollow shafts through which the primary gear (32) is keyed to the primary drive shaft (16) and through which, furthermore, the keying of the primary gear (32) to the primary drive shaft (16) occurs by resting said keying device (34) on the overhanging collar (33) without causing undesired deformations of the gear body. In this way it is possible to obtain an optimal precision of coupling of the gears (32, 35) such as to ensure a high mechanical strength of the drive along with a significant reduction in the vibrations generated during the rotation of the drive shafts (16, 17) in such a way as to obtain an optimal rotation of the positive displacement screw rotors (4, 5) themselves with a consequent overall improvement of the yield of the rotary positive displacement pump (1) especially in the case in which it is operated at a high rotation speed of the positive displacement screw rotors (4, 5).

As an alternative, the keying device (34) for hollow shafts that can be employed can also be of the type made in three pieces, consisting of an internal ring externally shaped with opposite conical surfaces and longitudinally cut and of two external flanges connected to each other by a series of threaded engagement devices (11) arranged in a radial pattern. Both in the case in which said keying device (34) is of the type made in two pieces and in the case in which it is made in three pieces, its use for engaging the primary gear (32) to the primary drive shaft (16) allows to achieve all the advantages of such a type of keying as well as, as a consequence, to advantageously contribute to the significant improvement in the realization of a clearance-free drive. The employment of such an engagement system by means of a keying device (34) allows, also due to the non-requirement of arranging a seat for a tongue or key, to keep the integrity of the strong section of the primary drive shaft (16) in such a way that the maximum torque for the size of the keying section can be transmitted to the primary drive shaft (16), since power is distributed over the whole contact surface. Further advantages also consist, in addition to a significant facilitation of the assembly and disassembly of the primary gear (32), of the greater ease and precision of positioning and alignment of the primary gear (32) with respect to the secondary gear (35) on which said primary gear (32) itself is engaged and of the possibility of keeping a structure and sizing of the primary gear (32) itself such as to ensure a greater mechanical strength thereof.

In order to be able to synchronously transmit the rotary motion from the primary drive shaft (16) to the secondary drive shaft (17), in the embodiment disclosed the secondary gear (35), which is monolithic, too, is engaged to the secondary drive shaft (17) itself by means of a key connection (36) of the known type, to this purpose said secondary drive shaft (17) being provided with a suitable restraint seat (37) in which said key (36) is housed. For the same purpose of engaging the secondary gear (35) to the secondary drive shaft (17), the secondary gear (35) itself is provided with a suitable connection seat (38) for constraining the key (36). Furthermore, for the purpose of engaging the secondary gear (35) to the secondary drive shaft (17), the secondary drive shaft (17) is provided with a vertical wall (171), placed in correspondence of the end part of the keying portion occupied by the restraint seat (37) for the key (36), wherein the vertical wall (171) is arranged to facilitate the centring and the correct positioning of the secondary gear (35) on the secondary drive shaft (17), said vertical wall (171) constituting an abutment on which the secondary gear (35) is intended to rest. In this way, the rotation of the primary drive shaft (16), thanks to the primary gear (32) gripping the secondary gear (35), allows to synchronously perform the counter-rotation of the secondary drive shaft (17) with respect to the rotation of the primary drive shaft (16) and, as a consequence, to synchronously counter-rotate the positive displacement screw rotors (4, 5), which are keyed to the drive shafts (16, 17).

In order to achieve the advantages deriving from a greater reduction in the overall dimensions of the drive section (2) and consequently of the whole positive displacement pump (1), as well as to obtain a suitable lubrication and heat dissipation of the moving devices, in particular of the bearing units (18, 19, 20, 21), both the positioning of the primary gear (32) with the associated keying device (34) and, as a consequence, the positioning of the secondary gear (35) are performed between the first bearing unit (18) and the second bearing unit (19) and between the third bearing unit (20) and the fourth bearing unit (21), respectively. In a known way, in order to seal the drive section (2), in particular the lubrication chamber (7), to prevent leaks that may contaminate the product being processed if said leaks reached the product section (3), both the primary drive shaft (16) and the secondary drive shaft (17) are suitably provided with known sealing devices (28), which in the embodiment disclosed are in the form of oil sealing rings, which are placed at least in correspondence of the section of the drive shafts (16, 17) coming out of the back wall (39), opposite the head wall (23), of the drive housing (6), wherein to this purpose said back wall (39) is provided with suitable recessed seats (40) intended for advantageously housing said sealing devices (28) consisting of oil sealing rings.

Both the primary drive shaft (16) and the secondary drive shaft (17), which are both monolithic, are structured in such a way as to comprise a portion coming out of the back wall (39) of the drive housing (6), said portion coming out of the back wall (39) extending from the back wall (39) itself of the drive housing (6) up to most of the longitudinal development of the product section (3). In greater detail as to the embodiment disclosed, the portion of the drive shafts (16, 17) that occupies the product section (3) is identically shaped both for the primary drive shaft (16) and for the secondary drive shaft (17), it being structured in such a way as to be able to engage the positive displacement screw rotors (4, 5). In particular, in the embodiment disclosed, the primary drive shaft (16) engages the first positive displacement screw rotor (4) and the secondary drive shaft (17) engages the second positive displacement screw rotor (5), wherein, for the purpose of reciprocal engagement, both the drive shafts (16, 17) and the positive displacement screw rotors (4, 5) have complementary shape adaptations, in the embodiment disclosed given by the grooved profiles with which both the ends of the drive shafts (16, 17) and the corresponding part of the engagement seat (46) of the positive displacement screw rotors (4, 5) are provided, the latter being further engaged to the drive shafts (16, 17) by means of threaded engagement devices (11). Said positive displacement screw rotors (4, 5), for functional purposes, are installed in a reciprocal co-penetration condition. As it is particularly shown in FIG. 3, in FIG. 5 and in FIG. 4 as well, the product section (3) comprises a separating plate (41), constituting the back wall of the product section (3), said separating plate (41) being constrained to the back wall (39) of the drive housing (6) in adhesion to some overhanging portions (42) with which said back wall (39) is provided in such a way that the separating plate (31) over part of its area does not fully adhere to the back wall (39) so that, in the embodiment disclosed, between the back wall (39) of the drive housing (6) and the separating plate (41) there are some discharge openings (43) in communication with the outside and acting as discharge areas intended to allow, in case of breaking of the sealing devices (28) with which the drive shafts (16, 17) are provided in correspondence of the section from which they come out of the back wall (39) of the drive housing (6), any consequent leaks of lubricant from the lubrication chamber (7) to flow outside, thus avoiding the danger that the leaked lubricant may contaminate the product to be treated in the product section (3). In greater detail as to the embodiment disclosed, said separating plate (41) constituting part of the product section (3) is provided with suitable through-openings (44) of the known type intended to enable the passage of at least part of the drive shafts (16, 17) and, in the embodiment disclosed, the separating plate (41) in correspondence of said through-openings (44) being also intended to enable the positioning of at least the static part of at least one mechanical sealing device (45) with which the drive shafts (16, 17) are provided, said mechanical sealing devices (45) being of the known type and being intended to ensure the suitable tightness of the fluid being processed in the product section (3). Furthermore, the engagement of the separating plate (41) to the back wall (39) of the drive housing (6), in the embodiment disclosed, occurs by using coupling pins and threaded engagement devices (11) of the known type. A one-piece stator body (47) is joined to said separating plate (41) on the side of the product section (3), said one-piece stator body (47) incorporating a product inlet duct (48) and realizing part of a treatment chamber (49), which is made in a known way so that the synchronous counter-rotation of the positive displacement screw rotors (4, 5) may cause the movement of the treated product from the product inlet duct (48) to a product outlet duct (50) with which a head body (51) is provided, which is associated in a sealing condition with the stator body (47), in the embodiment disclosed by means of threaded engagement devices (11) consisting of threaded stud bolts, said head body (51) being made in such a way as to constitute part of the treatment chamber (49). In the case in which the positive displacement pump (1) is made in such a way as to be reversibly operable, the product inlet duct (48) and the product outlet duct (50) will be reversible according to the feeding direction. Furthermore, in the embodiment disclosed, the positive displacement pump (1) in correspondence of the drive section (2) is provided with support bodies (52) for supporting and anchoring the positive displacement pump (1) itself to the worktop.

Considering the described structure of the positive displacement pump (1), its assembly must occur by following specific assembly sequences, with particular reference to the positioning of the components of the drive section (2) and in particular, given the structure of the drive housing (6), which is in one piece, of the drive shafts (16, 17) and of the respective bearing units (18, 19, 20, 21) by which said drive shafts (16, 17) are supported, as well as of the gears (32, 35) and of the keying device (34) whose diameters prevent assembly with bearing units (18, 19, 20, 21) already mounted on the drive shafts (16, 17). Operatively, the assembly of the positive displacement pump (1) provides that, before installing the drive shafts (16, 17), the oblique bearings of the first bearing unit (18) and of the third bearing unit (20) and the external rings (53) and the needle crowns of the needle bearings of the second bearing unit (19) and of the fourth bearing unit (21) are pre-assembled on the drive housing (6). Furthermore, the bearing locking plate (24), too, is engaged to the head wall (23) of the drive housing (6). Before inserting the drive shafts (16, 17) on the drive housing (6), the internal rings (55) of the needle bearings of the second bearing unit (19) and of the fourth bearing unit (21) are pre-assembled on the drive shafts (16, 17) themselves.

In the embodiment disclosed, given the size of the drive housing (6) and in particular of the lubrication chamber (7) for containing the primary gear (32), the keying device (34) and the secondary gear (35), the insertion of the drive shafts (16, 17) must occur in such a way that, during their introduction, the primary gear (32) and the keying device (34), for the primary drive shaft (16), and the secondary gear (35) for the secondary drive shaft (17) must be pre-positioned in the lubrication chamber (7) so that, after the insertion of the corresponding drive shaft (16, 17), the insertion of said primary gear (32), keying device (34) and secondary gear (35) may take place. In greater detail, in order to facilitate and enable the correct positioning of the primary gear (32), of the keying device (34) and of the secondary gear (35) on the respective drive shafts (16, 17), one has to suitably position a removable guiding device (not shown) consisting of a tubular body having an external diameter compatible respectively with the insertion in the first bearing unit (18) and in the third bearing unit (20), in correspondence of the internal rings (55), said removable guiding device being also provided with an abutment that enables, upon complete insertion, its perfect support in abutment onto the internal ring (55) of the bearings of the first bearing unit (18) and third bearing unit (20). Operatively, first of all the primary drive shaft (16) is inserted, to this purpose it being necessary to position beforehand said removable guiding device suitably inserted on the first bearing unit (18) in the direction of the lubrication chamber (7) in such a way that the abutment with which it is provided rests in a bearing condition on the internal ring (55) of the respective oblique ball bearing of the first bearing unit (18), wherein the removable guiding device is of such a length as to comprise a portion coming out of the first bearing unit (18), when inserted therein, in such a way that on said portion of the removable guiding device it is possible to insert, being supported thereby, the primary gear (32) and the keying device (34), respectively, which in this way will be supported in axis with respect to the axis of the primary drive shaft (16) being inserted on the drive housing (6). The primary drive shaft (16) must be inserted through the second bearing unit (19) in the direction of the first bearing unit (18). In this way, the primary drive shaft (16) that is advanced through the second bearing unit (19), as it is pushed forward, will engage in sequence: the keying device (34), the primary gear (32) and the first bearing unit (18) in such a way that the forward movement of the primary drive shaft (16) will consequently cause the removable guiding device to come out until the latter can be removed once the primary drive shaft (16) has engaged the keying device (34) and the primary gear (32), being then guided by the first bearing unit (18). The insertion of the primary drive shaft (16) will be complete once the latter has been pushed until reaching the final engagement position of the first bearing unit (18) and of the second bearing unit (19), in such a way that the internal ring (55) of the second bearing unit (19), which has been previously keyed to the primary drive shaft (16), is positioned correctly on the needle crowns (54) of the second bearing unit (19). In greater detail, after the primary drive shaft (16) has been positioned, the primary gear (32) will be engaged to the primary drive shaft (16) in such a way that the first keying seat (321) engages the first engagement portion (161) of the primary drive shaft (16) and the second keying seat (322) engages the second engagement portion (162) of the primary drive shaft (16), and in such a way that the vertical abutment wall (163) of the primary drive shaft (16) rests on the abutment wall (323) of the primary gear (32), which, with the end of the gear body opposite the overhanging collar (33), will rest on the internal ring (55) of the corresponding bearing of the first bearing unit (18).

For positioning the secondary drive shaft (17), too, one will operatively proceed first of all by inserting the removable guiding device in position on the third bearing unit (20) in the direction of the lubrication chamber (7), in such a way that it will be possible to position on the portion coming out of it the secondary gear (35), which will have been gripped onto the primary gear (32). The further positioning of the secondary drive shaft (17) occurs by advancing it through the fourth bearing unit (21) in the direction of the third bearing unit (20), in its forward movement the secondary drive shaft (17) engaging the secondary gear (35) as well. The forward movement of the secondary drive shaft (17) will consequently cause the removable guiding device to come out until the latter can be removed once the secondary drive shaft (17) itself has engaged the secondary gear (35) and is then guided by the third bearing unit (20). The insertion of the secondary drive shaft (17) will be complete once the latter has been pushed until reaching the final engagement position of the third bearing unit (20) and of the fourth bearing unit (21), in such a way that the internal ring (55) of the fourth bearing unit (21), which has been previously keyed to the secondary drive shaft (17), is positioned correctly on the needle crowns (54) of the fourth bearing unit (21). In greater detail, after the secondary drive shaft (17) has been positioned, the secondary gear (35) will be engaged to the secondary drive shaft (17) in such a way that the vertical wall (171) of the secondary drive shaft (17) itself abuts against the secondary gear (35). Once the drive shafts (16, 17) have been positioned correctly on the drive housing (6), one positions in a known way the safety washer (30) and the locking ferrule (31) of the first bearing unit (18) and mounts the locking ferrule (31) of the third bearing unit (20), after which one positions and engages the closing plate (25) on the head flange (26) of the head wall (23) of the drive housing (6).

Once the drive shafts (16, 17) have been positioned in the drive housing (6), the assembly of the positive displacement pump (1) continues by positioning the sealing devices (28), consisting of oil sealing rings, in the provided recessed seats (40) with which the back wall (39) of the drive housing (6) itself is provided. Furthermore, once said sealing devices (28) have been positioned on said recessed seats (40), one mounts the separating plate (41) on the back wall (39) of the drive housing (6), then suitably positioning, in a known way, the mechanical sealing devices (45) on the separating plate (41) and on the drive shafts (16, 17). The completion of the product section (3) of the positive displacement pump (1) according to the invention occurs by mounting the positive displacement screw rotors (4, 5) on the respective drive shafts (16, 17), said mounting of the positive displacement screw rotors (4, 5) necessarily having to occur with the positive displacement screw rotors (4, 5) pre-coupled in co-penetration as they have to be positioned for insertion on the drive shafts (16, 17) until correctly resting on the respective complementarily shaped couplings with which both the drive shafts (16, 17) and the positive displacement screw rotors (4, 5) are provided. Once the positive displacement screw rotors (4, 5) have been positioned on the drive shafts (16, 17) and have been adjusted with respect to each other, they are engaged to the drive shafts (16, 17) by means of threaded engagement devices (11). In greater detail, the reciprocal setting of the positive displacement screw rotors (4, 5) is also innovatively facilitated by the fact that the primary gear (32), thanks to the described structure of the latter and of the primary drive shaft (16), allows to perfectly centre the primary gear (32) on the primary drive shaft (16) even with the keying device (34) not fastened. In this way, thanks to the reciprocal cooperation of the engagement precision of the first keying seat (321) of the primary gear (32) with the first engagement portion (161) of the primary drive shaft (16) and of the engagement push performed by the primary drive shaft (16) by means of the vertical abutment wall (163) resting on the abutment wall (323) of the primary gear (32) pushing it in engagement with the internal ring (55) of the corresponding bearing of the first bearing unit (18), it is possible to keep an optimal centring of the primary gear (32) also during the setting of the positive displacement screw rotors (4, 5), when the primary gear (32) is free to rotate on the primary drive shaft (16) and, once the setting has been completed, to precisely keep said setting even after the fastening of the keying device (34), which, by acting on the overhanging collar (33) of the primary gear (32) and not altering its centring nor affecting the sizing of the gear body, allows to ensure a perfect maintenance of the setting of the positive displacement screw rotors (4, 5). Once the positive displacement screw rotors (4, 5) have been set and, by fastening the keying device (34), the primary gear (32) has been made integral with the primary drive shaft (16), in the assembly sequence the stator body (47) is engaged to the separating plate (41) and, afterwards, the stator body (47) is engaged to the head body (51).

REFERENCE (1) positive displacement pump
(2) drive section
(3) product section
(4) first positive displacement screw rotor
(5) second positive displacement screw rotor
(6) drive housing
(7) lubrication chamber
(8) opening
(9) closing cover
(10) perimeter engagement wall
(11) threaded engagement devices
(12) first bearing seat
(13) second bearing seat
(14) third bearing seat
(15) fourth bearing seat
(16) primary drive shaft
(161) first engagement portion
(162) second engagement portion
(163) vertical abutment wall
(17) secondary drive shaft
(171) vertical wall
(18) first bearing unit
(19) second bearing unit
(20) third bearing unit
(21) fourth bearing unit
(22) driving pivot
(23) head wall
(24) bearing locking plate
(25) closing plate
(26) head flange
(27) through-seat
(28) sealing device
(29) through-opening
(30) safety washer
(31) locking ferrule
(32) primary gear
(321) first keying seat
(322) second keying seat
(323) abutment wall
(33) overhanging collar
(34) keying device
(35) secondary gear
(36) key
(37) restraint seat
(38) connection seat
(39) back wall
(40) recessed seat
(41) separating plate
(42) overhanging portions
(43) discharge openings
(44) through-openings
(45) mechanical sealing device
(46) engagement seat
(47) stator body
(48) product inlet duct
(49) treatment chamber
(50) product outlet duct
(51) head body
(52) support bodies
(53) external rings
(54) needle crowns
(55) internal rings

The invention claimed is:

1. A rotary positive displacement pump comprising:

at least one drive section having a one-piece drive housing defining a lubrication chamber, the one-piece drive housing having an opening to the lubrication chamber, the opening abutting a closing cover, the one-piece drive housing having a plurality of bearing units wherein each one of the plurality of bearing units includes a plurality of bearing seats arranged in opposing pairs on a common axis and engaging at least one bearing, wherein a primary drive shaft and a secondary drive shaft are each rotationally engaged to a respective one of the at least one bearing, the primary drive shaft having at least one primary gear, the secondary drive shaft having at least one secondary gear, the at least one primary gear and the at least one secondary gear being interposed between the opposing pairs of the plurality of bearing seats such that the primary drive shaft and the secondary drive shaft counter-rotate with respect to each other; and a product section having a treatment chamber, wherein each of the primary drive shaft and the secondary drive shaft engage a respective positive displacement screw rotor positioned within a one-piece stator body, forming a pair of positive displacement screw rotors adapted to generate a product flow between at least one product inlet duct and a product outlet duct of said product section, wherein the at least one primary gear and the at least one secondary gear are monolithic, the at least one primary gear having at least one overhanging collar keyed to the primary drive shaft by a keying device, the keying device being engaged with the at least one overhanging collar, wherein the primary drive shaft has a first engagement portion and a second engagement portion, the first engagement portion having a diameter different than a diameter of the second engagement portion, the at least one primary gear having a first keying seat and a second keying seat, the first keying seat having a diameter different than a diameter of the second keying seat, the primary drive shaft has a vertical abutment wall, the vertical abutment wall having a height equal to a difference between the diameter of the second engagement portion and the diameter of the first engagement portion, wherein the first keying seat extends axially over a portion of the at least one primary gear, the second keying seat extending axially over an entire length of the at least one overhanging collar and over a portion of the at least one primary gear not within an area of the first keying seat, the second keying seat having an abutment wall adapted to bear against the vertical abutment wall of the primary drive shaft, wherein the at least one primary gear is centered with respect to an axis of said primary drive shaft when the at least one primary gear is engaged to the primary drive shaft with the first keying seat and the second keying seat on the first engagement portion and on the second engagement portion of the primary drive shaft respectively and with the abutment wall of the second keying seat resting on the vertical abutment wall of the primary drive shaft, the at least one primary gear resting on an internal ring of a corresponding one of said at least one bearing of a first bearing unit of the plurality of bearing units.

2. The rotary positive displacement pump of claim 1, wherein the secondary drive shaft has at least one vertical wall, the at least one secondary gear resting upon the at least one vertical wall of the secondary drive shaft.

3. The rotary positive displacement pump of claim 2, wherein the secondary drive shaft has at least one restraint seat having at least one key engageable by a connection seat, the at least one secondary gear having the connection seat thereon, wherein the secondary drive shaft has a vertical wall positioned so as to correspond to an end part of a keying portion occupied by the restraint seat, the at least one secondary gear resting on the vertical wall of the secondary drive shaft.

4. The rotary positive displacement pump of claim 1, wherein the one-piece drive housing has a back wall with an overhanging portion upon which a separating plate rests, the separating plate having through openings, the through openings allowing a portion of the primary drive shaft and the secondary drive shaft to pass therethrough, the separating plate supporting a mechanical sealing device, the separating plate being engaged with a one-piece stator body, the one-piece stator body having the at least one product inlet duct and includes at least a portion of the treatment chamber, the at least one portion of the treatment chamber having the pair of positive displacement screw rotors therein, the pair of positive displacement screw rotors being engaged with a portion of the primary drive shaft and the secondary drive shaft, wherein the one-piece stator body is engaged with a head body, the head body having the at least one product outlet duct.

5. The rotary positive displacement pump of claim 1, wherein the primary drive shaft and the secondary drive shaft extend in a direction of the first bearing unit.

6. The rotary positive displacement pump of claim 5, wherein the first bearing unit is assembled on a first bearing seat of the plurality of bearing seats, a third bearing unit being assembled onto a third bearing seat of the plurality of bearing seats, a second bearing unit having external rings of the plurality of bearing seats and needle crowns as the at least one bearing, a fourth bearing unit having external rings of the plurality of bearing seats and needle crowns of the at least one bearing, the first bearing unit and the third bearing unit being assembled with a bearing locking plate engaged with a head wall of the one-piece drive housing, wherein the primary drive shaft and the secondary drive shaft are assembled to the internal rings of the first bearing unit and the third bearing unit respectively.

* * * * *